US006300548B1

(12) United States Patent
Zhu et al.

(10) Patent No.: US 6,300,548 B1
(45) Date of Patent: Oct. 9, 2001

(54) MUSIC TIMER

(75) Inventors: Yunde Zhu; Wei Wang, both of Ningbo (CN)

(73) Assignee: Ningbo Yunsheng (Group) Co., LTD, Zhejiang Province (CN)

( * ) Notice: Subject to any disclaimer, the term of this patent is extended or adjusted under 35 U.S.C. 154(b) by 0 days.

(21) Appl. No.: 09/713,672

(22) Filed: Nov. 15, 2000

(30) Foreign Application Priority Data

Aug. 7, 2000 (CN) ..... 00 1 19585

(51) Int. Cl.[7] ..... G10F 1/06

(52) U.S. Cl. ..... 84/94.1; 84/94.2; 84/95.1; 84/95.2; 446/404

(58) Field of Search ..... 84/94.1, 94.2, 84/95.1, 95.2; 446/404

(56) References Cited

U.S. PATENT DOCUMENTS 4,319,101 * 3/1982 Bolin ..... 200/38 R
4,450,939 * 5/1984 Kitamura ..... 185/39
4,464,969 * 8/1984 Isaka et al. ..... 84/95.1
4,890,528 * 1/1990 Kamijima ..... 84/95.2
5,543,577 * 8/1996 Zhu et al. ..... 84/95.2
5,703,305 * 12/1997 Isaka ..... 84/95.1

* cited by examiner

*Primary Examiner*—Shih-Yung Hsieh
(74) *Attorney, Agent, or Firm*—Knobbe Martens Olson & Bear LLP

(57) ABSTRACT

A music timer comprises a timing unit, a music box unit and its mounting frame, a music control wheel (29) that has a gap (291) along its edge is driven to rotate by a driving gear through rotary axis of the driving spring of the timing unit; one end (3*a*) of a brake rod (3) always abuts against the edge of said music control wheel (29) and the other end (3*b*) extends into the damping mechanism of the music box unit to activate it when the end (3*a*) abuts against the non-gap places on said music control wheel, whereas when the end (3*a*) sinks into the gap (291) of said music control wheel, the end (3*b*) then departs from the damping mechanism of the music box unit, thus producing no influence on its movement. The present invention enables the timer to produce pleasant and lasting music at the end of the timing. Moreover, through the scientific spatial arrangement of the present invention, and the projected cross section of the device is much smaller than the sum of those of the timer and the music box unit.

14 Claims, 6 Drawing Sheets

MUSIC TIMER

BACKGROUND OF THE INVENTION

1. Field of the Invention

The present invention relates to a mechanical timer, particularly to a music timer that can play musical sound at a predetermined finishing time.

2. Description of the Prior Art

Conventional timers comprise a ticking mechanism, a power spring, an accelerating gear train and the ringing mechanism whose alarm bells ring usually when struck by the pendulum. However, there are apparent drawbacks of such a kind of timer: first, the sound produced by the alarm of the clock is monotonous; second, the duration of the alarm sound is short for it lasts only for about 5 seconds. Such a short monotonous sound of the conventional timers may produce a noisy impression, especially in quiet rooms, and it may even scare people.

SUMMARY OF THE INVENTION

In view of the foregoing disadvantages in the prior art, the object of the present invention is to provide a music timer that can play musical sound for a long time at a predetermined finishing time.

Another object of the present invention is to provide a music timer with a smaller projected cross section.

The objects of the present invention are thus realized: the music timer comprises a timing unit, a music box unit and a mounting frame, wherein the timing unit includes:

a ticking mechanism with a relatively regular ticking cycle;

a driving spring with a reel that serves as the source of power for the ticking mechanism;

an accelerating gear train, used to increase the winding speed of the rotary axis of the spring when said spring is released and transmit it to the ticking mechanism.

Said music box unit comprises:

a sound plate with comb-like vibrating teeth;

a roller that has many ejector pins on its outer circumference surface, said roller having a rotary axis and said sound plate, which is installed in the radial direction on the roller with the end of its comb-like vibrating teeth engaging with the ejector pins of said roller;

a driving spring having a reel, the reel serving as the source of power for said roller;

an accelerating gear train, used to increase the winding speed of the rotary axis of the spring when said spring is released and to transmit the power to the rotary axis of the roller;

a damping member, which is in engagement with said accelerating gear train and which can damp down the rotary movement of the accelerating gear train;

characterizing in that it also includes:

a music control wheel with a gap along its edge, and said control wheel is driven by the rotary axis of the driving spring of the timing unit through the spinning gear;

a brake rod, which is pivoted on a column of said mounting frame in the middle, its arm connected with a spring mechanism under whose force one end a of the rod is always pressed tightly against the edge of said music control wheel, while the other end b of the brake rod extends into the damping member of the music box unit in order to effect activation when the end a is pressed against the place of said music control wheel where there is no gap, and when the end a of the brake rod extends into the gap of said music control wheel the end b then moves away from the damping member of the music box unit, thus exerting no influence on the movement of the music box unit.

Compared with the prior arts, the present invention combines the mechanical timer with the music box ingeniously, enabling the timer to generate pleasant and lasting music at the end of the timing. Meanwhile, as the musical sound is generated by the music box unit having a damping member, it is smooth and can last an adequate time of more than 30 second. Furthermore, as a result of the reasonable spatial arrangement, the projected cross section of the present invention is much smaller than the sum of those of the timer and the music box unit and is only as large as any one of them; therefore, it is more convenient for use.

DESCRIPTION OF THE PREFERRED EMBODIMENT

Figure 1:
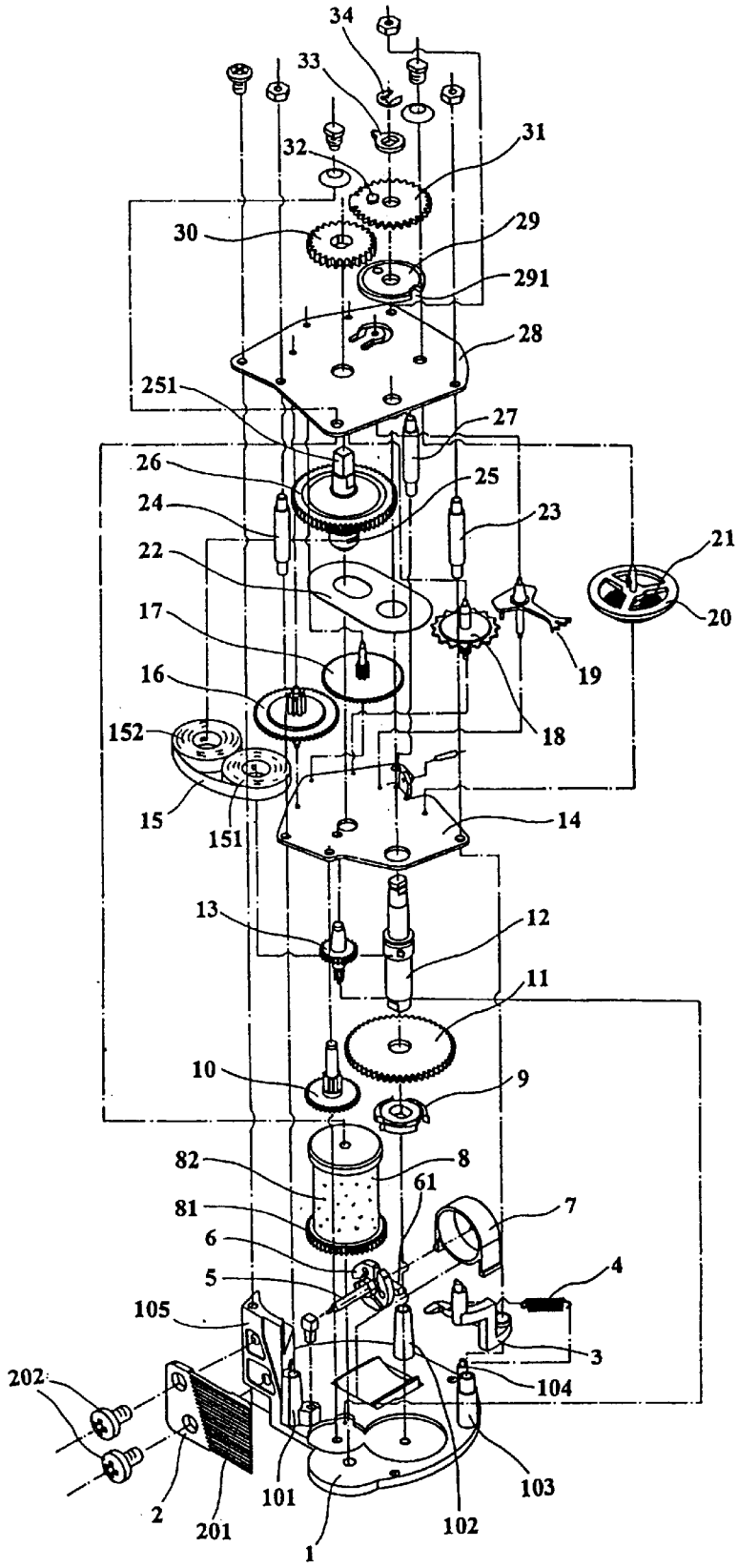
FIG. 1 is an exploded perspective view of the structure of an embodiment of the present invention.

Detailed descriptions of the present invention are provided below in connection with the embodiments shown in FIG. 1 to FIG. 6.

The embodiment shown in FIG. 1 to FIG. 6 comprises a timing unit, a music box unit and its mounting frame, and music control wheel 29 and a brake rod 3;

Wherein the timing unit comprises:

a hairspring-type escapement serving as the ticking mechanism that comprises an escape wheel 18, a lever fork 19, a balance wheel 20 and a hairspring 21 and having a stable ticking period. See FIG. 1 and FIG. 3;

a driving spring 152 having a reel 25, said spring 152 provides as the power source for the ticking mechanism of the timer. See FIG. 1;

an accelerating gear train, used to increase the winding speed of the rotary axis 25 of the spring when said spring 152 is released and transmit the power to the ticking mechanism, which includes a first gear 26, a second gear 16, a third gear 17 and an escape wheel 18, in which the first gear 26 is integrated with the rotary axis 25 of the driving spring, the second gear 16 engages with the first gear 26, the third gear 17 engages with the second gear 16, and escape wheel 18 engages with the third gear 17 and serves as the final output for said accelerating gear train. See FIG. 1, FIG. 3 and FIG. 6.

Figure 2:
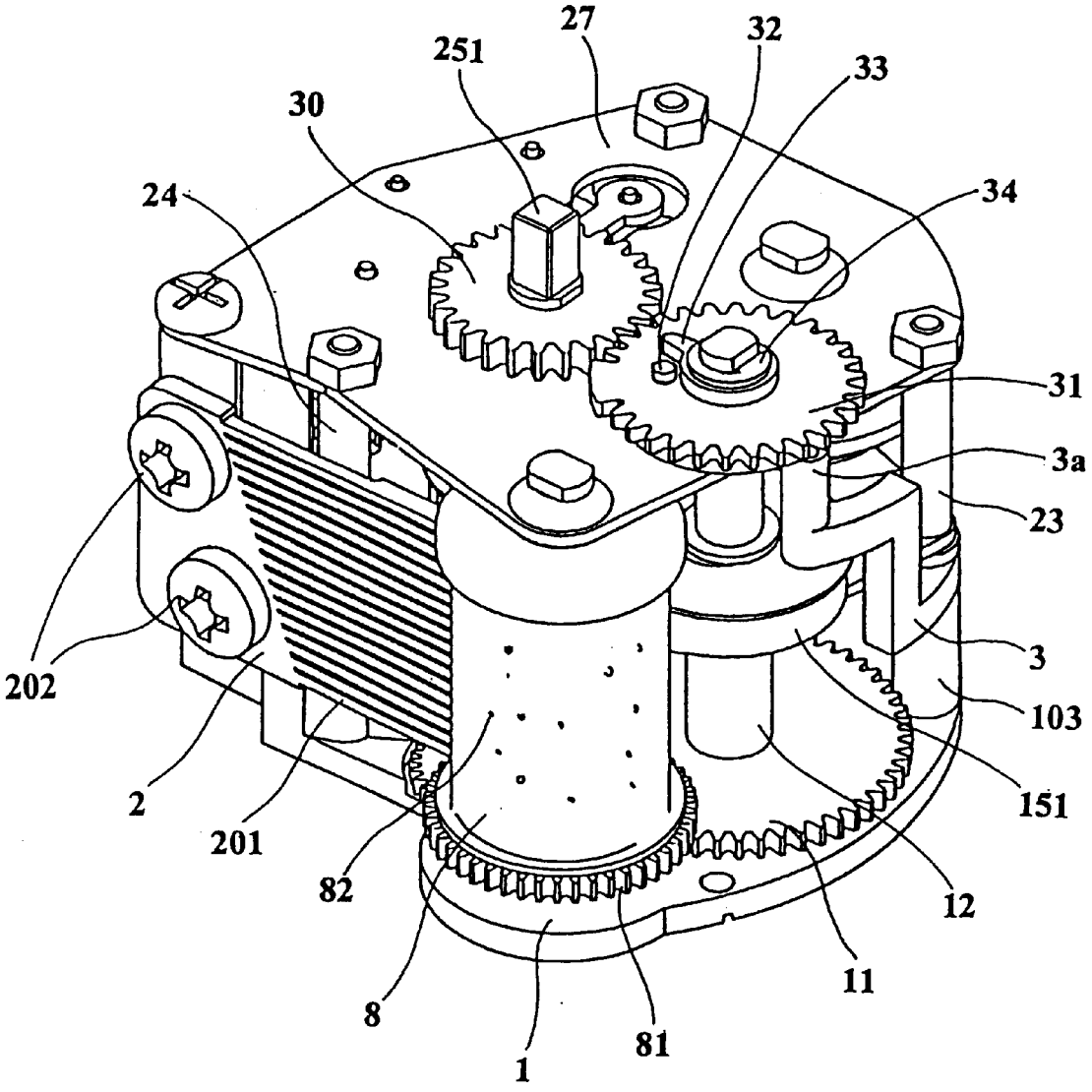
FIG. 2 is a perspective view showing the structure of the embodiment in FIG. 1.
Figure 3:
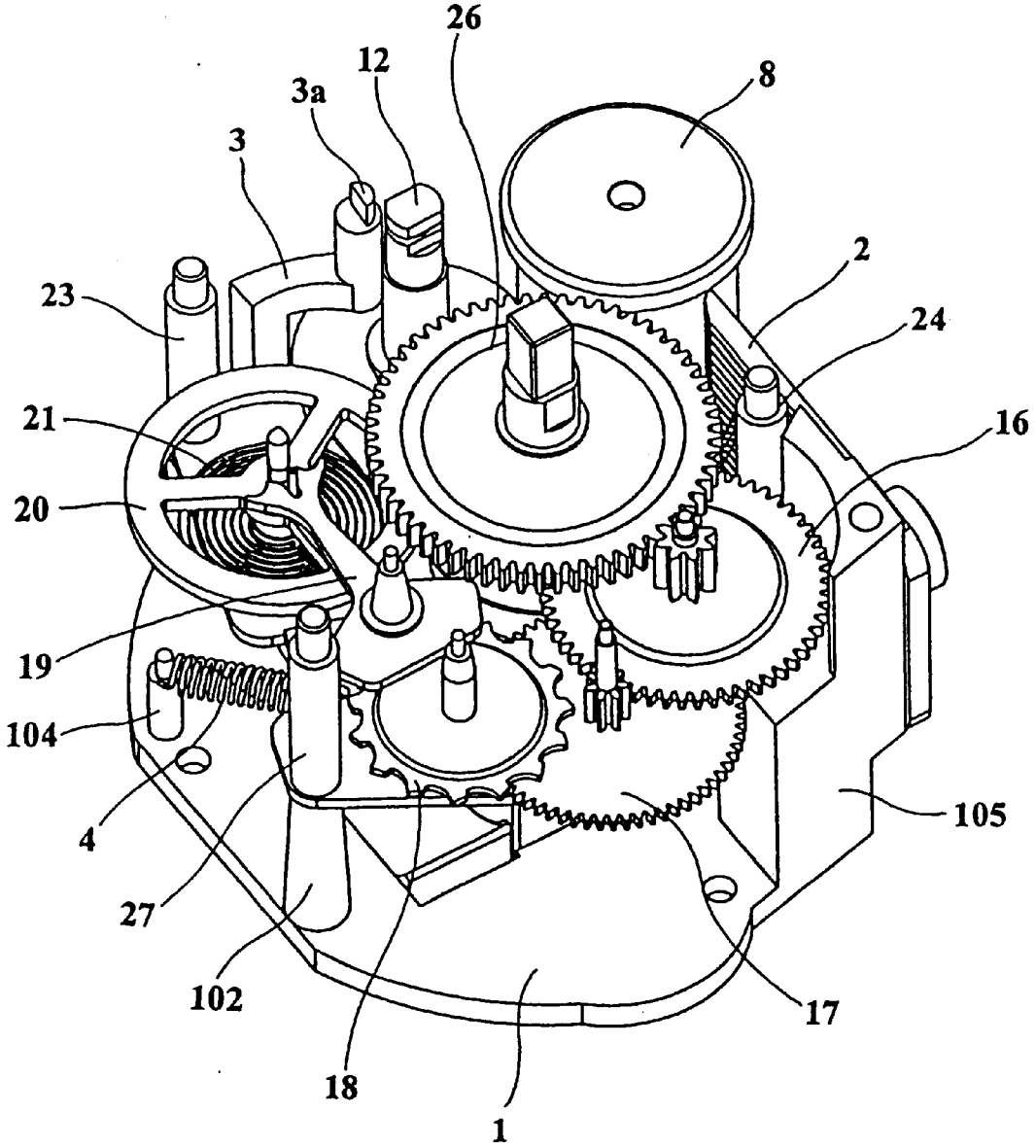
FIG. 3 is an exploded perspective view of the music timer viewed from the angle opposite to the viewpoint shown in FIG. 2, wherein the lower top plate (28) is taken off.

The music box unit comprises:

a sound plate 2 that has comb-like vibrating teeth as shown in FIG. 1, FIG. 2 and FIG. 3;

a roller 8 that has many ejector pins 82 on its outer circumference surface, said roller 8 having a rotary axis and said sound plate 2 is installed radially on the roller 8 and the end of the comb-like vibrating teeth 201 engage with the ejector pins 82 of said roller, as shown in FIG. 1, FIG. 2 and FIG. 3;

a driving spring 151 having a reel 12, said spring 151 serving as the source of power for said roller 8, as shown in FIG. 1;

an accelerating gear train, used to increase the winding speed of the rotary axis 12 of the spring when said spring 151 is released and transmit the power to the rotary axis of the roller 8, which includes a first gear 11, a second gear 81, a third gear 10 and a worm wheel 13. Said first gear 11 is fixed on the bottom of the rotary axis 12 of the driving spring and stuck to the base 1. A stop spring 9 is set between the bottom of the first gear 11 and the base 1 in order to prevent the first gear 11 from rotating when winding the driving spring 151. The second gear 81 is fixed on the bottom of said roller 8 and engages with the first gear 11. The third gear 10 engages with the second gear 81 and the worm wheel 13 engages with the third gear 10 and serves as the final output for said accelerating gear train. See FIG. 1, FIG. 2 and FIG. 6.

a damping member which engages with said accelerating gear train and damps down the spinning of the accelerating gear train; said damping member in the embodiment of the present invention includes a worm screw 5, a friction block 6 and a damping cap 7. The worm screw 5 engages with said worm wheel 13. The friction block 6 is fixed on the worm screw 5 and is located in the damping cap 7. When the friction block 6 rotates, there is friction between the side and the inner side wall of the damping cap 7, thus resulting in the production of a damping force. Said damping cap 7 has an aperture 71 on its back into which the lower end **3*b* of said brake rod 3 can insert. There is a brake crank 61 on the side of the friction block 6 that corresponds to the back of the damping cap 7. Said brake crank 61 is blocked by the upper end 3*b* of said brake rod, which enables the friction block 6 to move and causes the music box unit to stop, as shown in FIG. 1 FIG. 4, FIG. 5 and FIG. 6**.

The mounting frame is made up of three layers of mounting plate from top to bottom: a top plate 28, a medial plate 14 and a base 1, as shown in FIG. 1 and FIG. 2;

The driving spring 152 of said timing unit, the driving spring 151 of said music box unit, the accelerating gear train of the timing unit and the ticking mechanism of the timing unit are installed in the space between the top plate 28 and the medial plate 14, as shown in FIG. 1 and FIG. 3.

Figure 4:
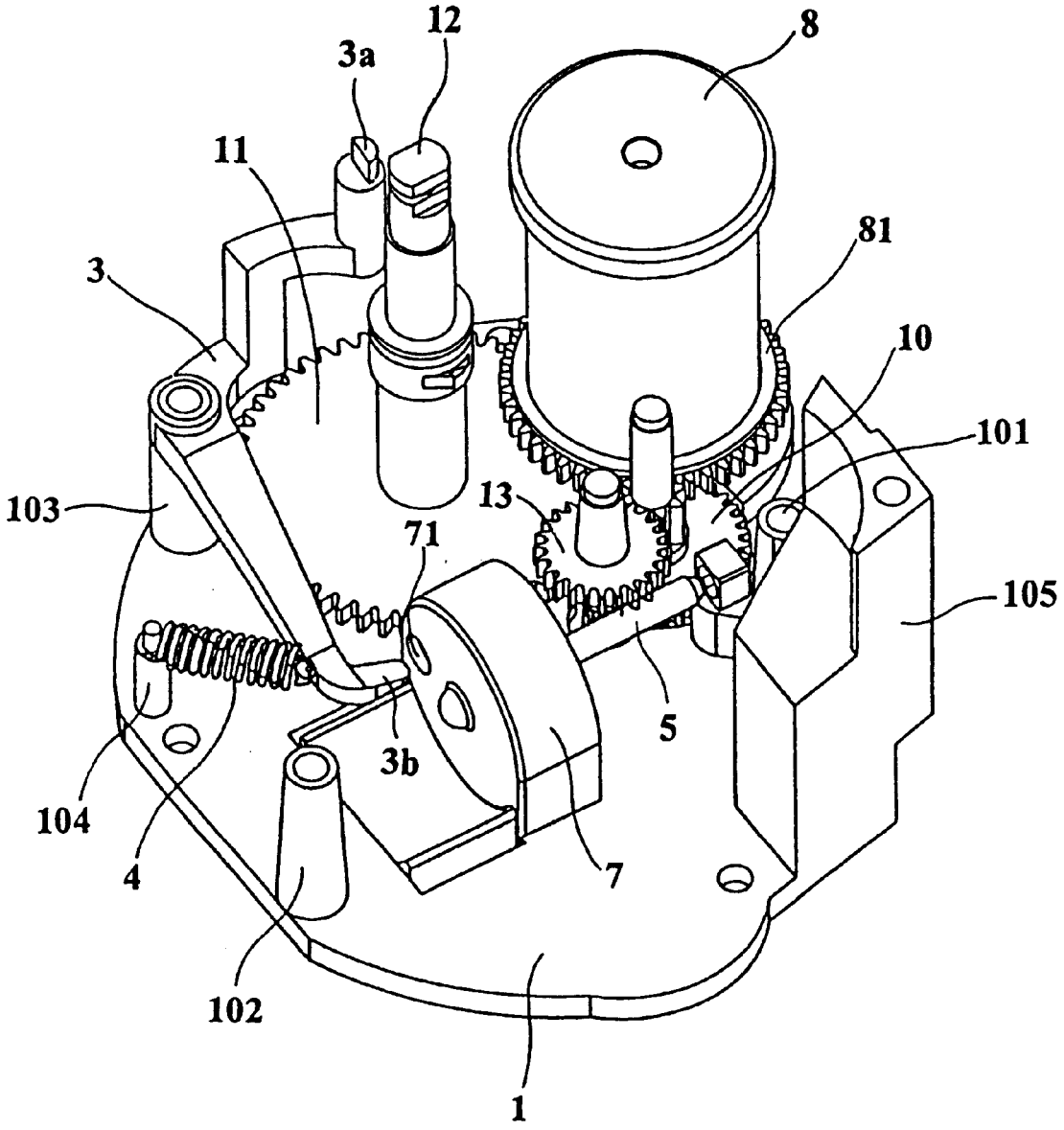
FIG. 4 is a perspective view showing the structure of the music timer in FIG. 3, wherein the medial plate (14) with the components on it and the sound plate (2) of the music box unit are taken off.
Figure 5:
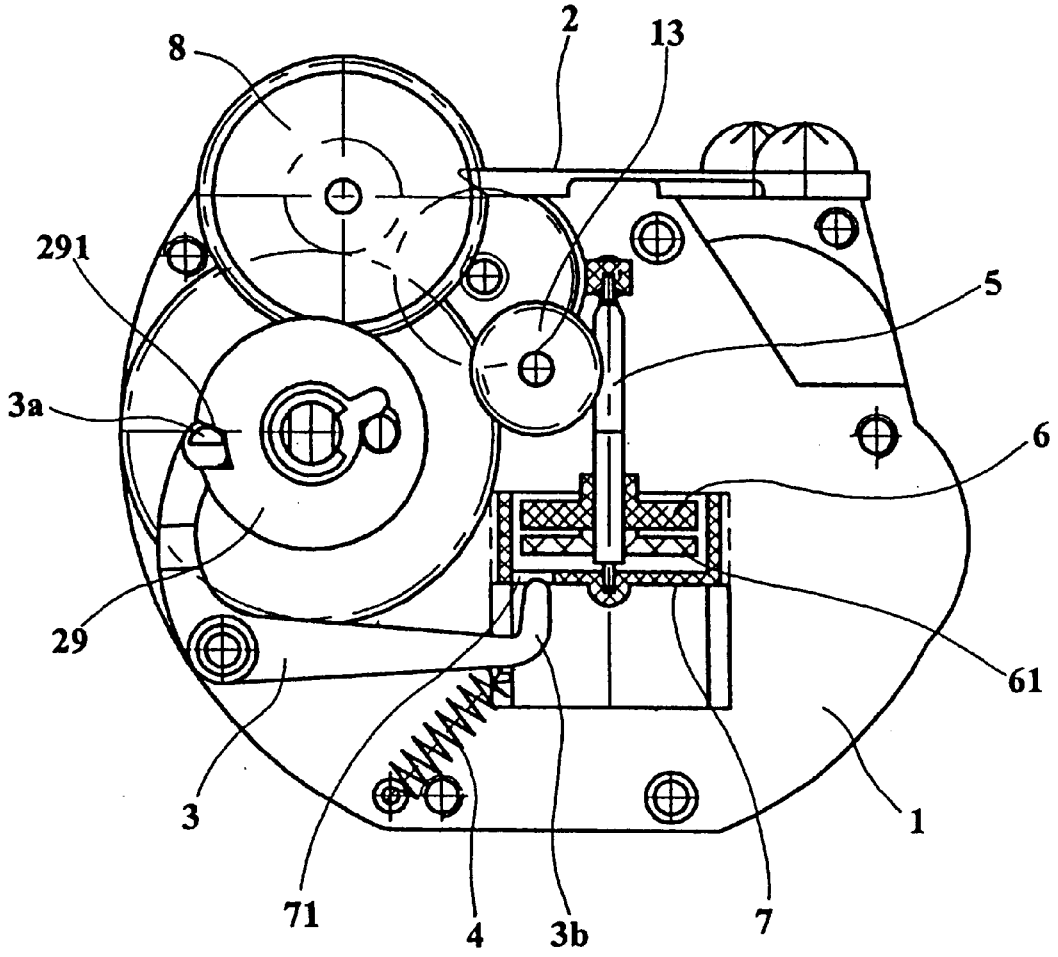
FIG. 5 is an top view showing the connection between the brake rod (3) and the music control wheel (29) in the timing unit and the damping member in the music box unit.
Figure 6:
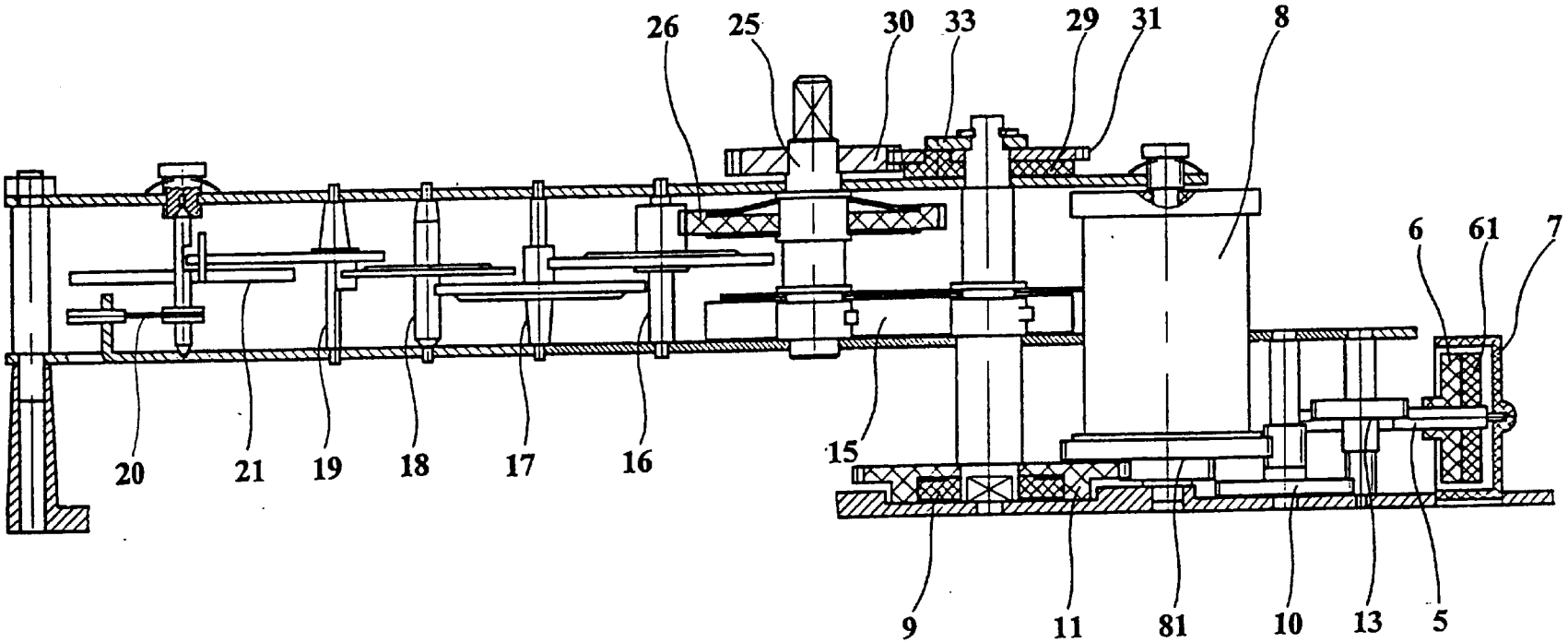
FIG. 6 is an expanded view showing the transmission principle of the two accelerating gear train shown in FIG. 1.

The accelerating gear train of said music box unit and the damping member are set in the space between the medial plate 14 and the base 1, as shown FIG. 1 and FIG. 4.

At one corner of said base 1 is set a vertical base 105, on whose one side there is a sidestep 101 in the middle. One corner of said medial plate 14 is supported by the sidestep 101 and is fixed by the upper puncheon 24 that goes with the sidestep 101. The top of said upper puncheon 24 supports one corner of the top plate 28; said comb-like sound plate 2 is fixed on the side face of the vertical base 105 by means of the bolt 202; said roller 8 is located at the corner that is adjacent to the corner of said base 1 and its top supports another corner of the top plate 28.

Two lower puncheons 102 and 103 are provided respectively at other two corners that face the vertical base 105 and the roller 8. The other two corners of said medial plate 14 are supported by the lower puncheons 102 and 103 and are fixed by the other two upper puncheons 27 and 23 that are fit by said lower puncheons 102 and 103 respectively. The upper ends of said two upper puncheons 27 and 23 support the other two corners of the top plate 28 and are fixed by two bolts respectively, as shown FIG. 1 to FIG. 4.

The driving spring 152 of said timing unit and the driving spring 151 of said music box unit are installed in the middle of the mounting frame, other components in the timing unit and the music box unit are mounted on the two sides that correspond to the mounting frame and surround their respective driving springs. In the embodiment of the present invention, the driving spring 152 of said timing unit and the driving spring 151 of said music box unit share the same spring 15 which coils into two spiral springs in different directions, their spiraling mode resembles a cassette tape of a recorder that is half wound. FIG. 1 shows the clamping piece 22 that fixes the spring. The upper end of the rotary axis 25 of the driving spring of said timing unit penetrates the top plate 28, on which a driving gear 30 is mounted. The upper end of the rotary axis 12 of the driving spring of said music box unit also penetrates the top plate 28, on which a driven gear 31 is mounted. Said driving gear 30 and the driven gear 31 engage with each other, as shown in FIG. 1 and FIG. 2.

There is a gap 291 along the edge of the music control wheel 29 which is below said driven gear 31 and is integrated into the driven gear 31 through a pin 32 which protrudes from the surface of said driven gear 31, on whose upper surface there is still a shifting fork 33, fixed on the rotary axis 12 of the driving spring of the music box unit through the circlip 34, and said pin 32 is located within the area that the protruding part of said shifting fork 33 sweeps across when it spins, as shown in FIG. 1 and FIG. 2.

The brake rod 3 is roughly curved and it is hinged on the lower puncheon 103 of the base near the curve, said lower puncheon 103 located at the corner that corresponds to the root of said comb-like sound plate. The lower arm **3*b* of the brake rod 3 is roughly parallel to the sound plate 2 and is located in the space between the medial plate 14 and the base 1, to which a tension spring 4 is connected. The other end of the tension spring 4 sheathes a puncheon 104 fixed on the base 1. Under the binding force of the tension spring 4, the upper end 3*a* of the brake rod 3 always abuts against the edge of said music control wheel 29. When the upper end 3*a* abuts against the non-gap places of said music control wheel 29, its lower end 3*b* extends into the aperture 71 on the back of the damping cap 7 of the damping member within the music box unit and blocks the stop lever 61 on the friction block 6, thus motivating the music box unit. And when the upper end 3*a* of the brake rod 3 extends into the gap 291 of said music control wheel 29, its lower end 3*b* then moves away from the aperture 71 on the back of the damping cap, thus producing no influence on the movement of the music box unit. See FIG. 1, FIG. 4 and FIG. 5**.

In actual manufacturing, there should also be a casing that encases all the components. The drawing is omitted here.

When in use, a clockwork spring key or another object is used to turn the rotary axis 25 of the driving spring of the timing unit so as to wind the driving spring 152. At this time, the driving gear 30 spins and drives the driven gear 31 to spin. Because the music control wheel 29 is integrated with the driven gear 31 through a pin 32, the music control wheel 29 spins with the driven gear 31. And because the upper end **3*a* of the brake rod 3 is pushed out of the gap 291 along the edge of the music control wheel 29, its lower end 3*b* then extends into the damping cap 7 of the music box unit, thus activating the damping member. The music box unit is consequently in a lock-in state and does not produce any motion; and when the driven gear 31 spins the pin 32 that is fixed on it spins with the shifting fork 33. As the shifting fork 33 is fixed on the rotary axis 12 of the driving spring of the music box unit, the driving spring 151** of the music box unit is consequently wound.

When the driving spring 15 is wound, the rotary axis 25 of the driving spring of the timing unit can be rewound to set the timing interval. At this time, the driving gear 30 also revolves in the opposite direction with the driven gear 31; therefore, the pin 32 draws back in relation to the shifting fork 33, which remains motionless with the rotary axis 12 of the driving spring of the music box unit. When the clockwork spring key is released, the driving spring 152 of the timing unit then begins to be released and the rotary axis 25 starts to reverse, and there is a gradual increase in its reversing speed from the first gear 26 to the second gear 26 to the third gear 17 to the escape wheel 18. The lever fork 19 shakes from one side to side under the combined control of the escape wheel 18, the balance wheel 20 and the hairspring 21. During each swing, a tooth on the escape wheel is released and the timing unit begins timing.

When the timing is finished, the rotary axis 25 of the driving spring timing unit reverts to its original position; therefore, the driving gear 30 and the driven gear 31 are restored to their original positions, and the upper end 3*a* of the brake rod 3 again sinks into the gap 291 on said music control wheel, while the lower end 3*b* of the brake rod departs from the damping box 7 of the music box unit. The driving spring 151 of the music box unit begins to be released and the rotary axis 12 starts reversing, its speed increasing in order from the first gear 11 to the second gear 81 to the third gear 10 to the worm wheel 13 gradually. The worm screw 5 of the damping member and the friction block 6 are driven to spin, and at the same time, the roller 8 that is fixed on the second gear 81 also starts revolving with the second gear 81. The ejector pin 82 on the outer circumference of the roller 8 plucks the corresponding comb teeth 201 of the sound plate 2 and produce musical sound. The rotary axis 12 of the driving spring in the music box unit reverts finally to its starting position and the musical sound then ends, at the same time, the shifting fork 33 integrated with the rotary axis 12 of the driving spring also is restored to its original position.

One working process thus ends. If further use is needed, the above steps should then be simply repeated.

What is claimed is:

1. A musical timer comprising:

a timing unit comprising:

a ticking mechanism having a stable ticking period;

a first driving spring; and a first accelerating gear train interconnecting the ticking mechanism and the first driving spring so as to increase a winding speed of the first driving spring wherein the first accelerating gear train transfers potential energy stored in the first driving spring to the ticking mechanism so as to provide mechanical power to the ticking mechanism;

a music box unit comprising:

a sound plate having a plurality of vibrating teeth having first ends;

a roller having a plurality of ejector pins disposed about the outer circumference of the roller wherein the roller defines a rotary axis and wherein the sound plate is positioned tangentially adjacent the roller such the first ends of the vibrating teeth engage with the ejector pins;

a second driving spring;

a second accelerating gear train comprising a worm wheel as final output wherein the second accelerating gear train interconnects the roller and the second driving spring wherein the second accelerating gear train is adapted to increase a winding speed of the second driving spring and wherein the second accelerating gear train transfers potential energy stored in the second driving spring to the roller so as to induce rotational motion of the roller about the rotary axis;

a damping member engaged with the second accelerating gear train wherein the damping member selectively inhibits motion of the second accelerating gear train;

a first driving gear connected to the first driving spring;

a music control wheel defining a gap positioned on the periphery of the music control wheel wherein the music control wheel is connected to the first driving gear; a tension spring; and a brake rod pivotable about a middle part and defining an upper and lower arm wherein the lower arm of the brake rod is connected to the tension spring such that the tension spring biases the upper arm of the brake rod to bear on the periphery of the music control wheel and such that the lower arm of the brake rod is biased to engage the damping member so as to inhibit motion of the second accelerating gear when the upper arm of the brake rod is not adjacent the gap in the music control wheel and further such that the lower arm of the brake rod is biased to disengage from the damping member when the upper arm of the brake rod is adjacent the gap of the music control wheel so as to allow motion of the second accelerating gear; and a mounting frame supporting the timing unit and the music box unit.

2. The musical timer of claim 1, wherein the first and second driving springs are mounted at a vertical midpoint of the mounting frame and wherein the timing unit is mounted on a first vertical side of the midpoint of the mounting frame and the music box unit is mounted on a second vertical side of the midpoint of the mounting frame opposite the first side.

3. The musical timer of claim 2, wherein the mounting frame comprises:

a top plate;

a medial plate;

a base;

at least one upper puncheon extending between and interconnecting the top plate and the medial plate; and at least one lower puncheon extending between and interconnecting the medial plate and the base.

4. The musical timer of claim 3, wherein the first and second driving springs, the first accelerating gear train, and the ticking mechanism are installed between the top plate and the medial plate and wherein the second accelerating gear train, the brake rod, the roller, the sound plate, and the damping member are installed between the medial plate and the base and wherein the lower arm of the brake rod is straight and generally parallel to the sound plate and wherein the upper arm of brake rod is arcuate.

5. The musical timer of claim 4, wherein the base comprises a vertical post having a sidestep located approximately at a vertical midpoint of the vertical post and wherein the medial plate rests on the sidestep and wherein a first end of an upper puncheon secures the medial plate and a second end of the upper puncheon supports the top plate and wherein the sound plate is attached to the base with at least one bolt and wherein the brake rod is pivotably mounted to a lower puncheon.

6. The musical timer of claim 4, wherein the tension spring acts in tension and is attached to a lower puncheon.

7. The musical timer of claim 4, wherein the damping member comprises:

a worm screw engaged with the worm wheel;

a friction block fixedly attached to the worm screw; and a damping cap encasing the worm screw and the friction block and bearing on the friction block such that, as the friction block rotates in response to rotation of the second accelerating gear train and the worm wheel, friction develops between the friction block and the damping cap so as to inhibit rotation of the friction block, the worm screw, the worm wheel, and the second accelerating gear train.

8. The musical timer of claim 7, wherein the second accelerating gear train comprises:

a first gear driven by the second driving spring;

a second gear engaged with the first gear and fixedly attached to a bottom of the roller; and a third gear engaged with the second gear and the worm wheel.

9. The musical timer of claim 3, further comprising a second driving gear and a driven gear mounted to the top plate such that the second driving gear engages the driven gear.

10. The musical timer of claim 9, wherein the music control wheel is interconnected with the driven gear via a pin.

11. The musical timer of claim 10, further comprising a shift fork driven by the second driving spring wherein the music control wheel is positioned below the driven gear and the pin protrudes above an upper face of the driven gear such that the shift fork engages with the pin as the shift fork rotates.

12. The musical timer of claim 1, wherein the first and second driving springs are opposingly wound coils of a single piece of spring material.

13. The musical timer of claim 1, wherein the ticking mechanism comprises:

an escape wheel providing the final output of the timing unit;

a lever fork engaged on a first end with the escape wheel;

a balance wheel engaged with a second end of the lever fork; and a hairspring attached to the balance wheel.

14. The musical timer of claim 13, wherein the first accelerating gear train comprises:

a fourth gear attached to the second driving gear;

a fifth gear engaged with the fourth gear; and a sixth gear engaged with the fifth gear and the escape wheel.

* * * * *